US005727849A

United States Patent [19]

Nelson

[11] Patent Number: 5,727,849

[45] Date of Patent: Mar. 17, 1998

[54] MODULAR CHAIR

[75] Inventor: Laurence A. Nelson, Knoxville, Tenn.

[73] Assignee: P.L, Inc., Athens, Tenn.

[21] Appl. No.: 646,025

[22] Filed: May 7, 1996

[51] Int. Cl.[6] ..... A47C 7/00

[52] U.S. Cl. ..... 297/440.16; 297/440.21

[58] Field of Search ..... 297/440.1, 440.13, 297/440.14, 440.15, 440.16, 440.17, 440.2, 440.21

[56] References Cited

U.S. PATENT DOCUMENTS

| | | | |
|---|---|---|---|
| 2,456,794 | 12/1948 | Richardson | 297/440.21 |
| 3,989,298 | 11/1976 | Cycowicz et al. | 297/440.21 X |
| 4,066,295 | 1/1978 | Severson | 297/440.16 |
| 4,890,888 | 1/1990 | Kostin | 297/440.21 |
| 5,269,589 | 12/1993 | Brothers et al. | 297/440.16 |
| 5,498,065 | 3/1996 | Tosoni | 297/440.16 X |

*Primary Examiner*—Laurie K. Cranmer
*Attorney, Agent, or Firm*—Lee, Mann, Smith, McWilliams, Sweeney & Ohlson

[57] ABSTRACT

A modular chair having a seat portion and a removable back portion. The back portion is joined to the seat portion by means of a pair of double taper elements on the back portion which engage corresponding channel elements formed in the seat portion. When joined, the two portions are secured to one another and are normally not separated.

13 Claims, 3 Drawing Sheets

MODULAR CHAIR

BACKGROUND OF THE INVENTION

This invention relates to chair structures, and more specifically to a modular chair having a seat portion and a back portion, with the two portions being formed to be joked after the seat portion and the back portion have been fully fabricated.

In the furniture industry, not only is it important that chairs be formed to promote comfort and appeal to the aesthetic tastes of the owner, but also it is important, for shipping purposes, that the chair be as compact as possible to reduce costs. A typical upholstered chair, such as a desk chair or conference chair, is formed about a frame, fully upholstered and then packaged for shipment to the customer. However, because such a chair has a high back extending well above the as of the chair, the chair occupies considerable volume, resulting in rather considerable shipping costs.

Efforts in the past have been made to make upholstered chairs more modular, with one result berg that shipping costs are reduced. For example, U.S. Pat. No. 5,000,512 discloses upholstered seating units which are formed in a modular manner. As a result, the upholstered members can be shipped in a knocked down fashion, reducing shipping volume and shipping cost.

SUMMARY OF THE INVENTION

The invention pertains to a modular chair which has a seat portion and a back portion. Means is provided for joining the back portion to the seat portion, that means comprising a pair of double taper elements, with each double taper element being located on an opposite side of the back portion. A pair of corresponding channel elements are provided, each channel element being shaped to receive one of the double taper elements. Means is also provided for securing the back portion to the seat portion when the two have been joined.

In accordance with the preferred form of the invention, the means for securing the back portion to the seat portion comprises at least one barb on one of the elements which engages a recess in the other of the elements. In the preferred form of the invention, the barbs are located on flexible arms extending from the taper elements, and the recesses are located in the channel elements.

Each double taper element comprises an elongated wedge with a web securing the wedge to and spacing the wedge from the back portion. Each wedge is tapered from its top to its bottom, and the web is formed such that the top of the wedge is closer to the back than is the bottom of the wedge.

Each channel element preferably comprises a plurality of vertical channel sections located one above another. The channel elements and the taper elements cooperate to firmly wedge the back portion to the seat portion when they are joined.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
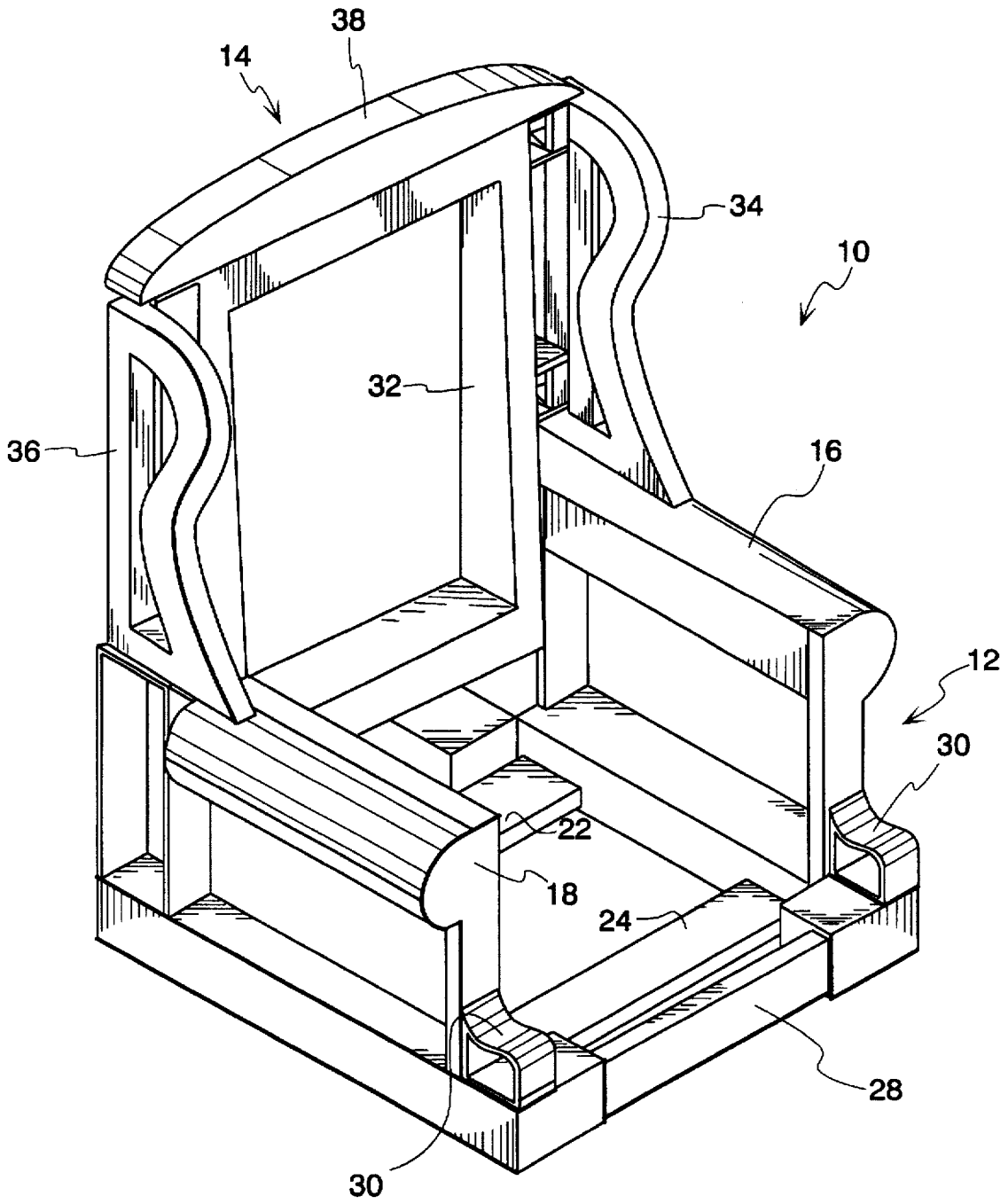
FIG. 1 is a perspective view of the frame of a modular chair according to the invention, when fully assembled.

The modular chair according to the invention is shown generally at 10 in the drawing figures. The modular chair 10 is composed of two basic elements, a seat portion 12 and a back portion 14. For the sake of description, the modular chair 10 is shown simply as frame elements without any padding or upholstery. It will be understood that the chair normally is upholstered, and the seat portion and the back portion are first upholstered before being joined. Upholstering forms no part of the invention, and can be accomplished in any conventional fashion.

As depicted in the drawing figures, the seat portion 12 is composed of a series of interfitting elements. It is preferred that all of the elements be formed of molded plastic, although, obviously, the elements can also be fabricated from other materials as appropriate. As depicted, the seat portion 12 includes opposite arm sections 16 and 18 which are joined by a series of horizontal slats 20 through 26 and a horizontal cover 28. The slats 20 through 26 and cover 28 are fitted into appropriate apertures in the opposite arm sections 16 and 18, and the entire seat portion 12 is joined together, such as by stapling or adhesives, or heating, or any other means of joining the parts together. Also, to aid in proper positioning and shaping of upholstering fabric, shaping guides 30 can be employed as needed or desired.

The particular formation of the arm sections 16 and 18, and the number of horizontal slats 20 through 26 will depend on the nature of the chair being fabricated. One form has been shown in the drawing figures, but it will be apparent to one of ordinary skill in the an that more and other elements can be employed, as needs dictate.

The back portion 14 is formed of a rear frame 32 with opposite wings 34 and 36. A top cap 38 is optionally used for proper shaping of the back portion when upholstered, if a more rounded top of the back portion 14 is desired.

For the purposes of shipping, the seat portion 12 and the back portion 14 are formed separately and are separately upholstered, are shipped in a knocked down form, and then are assembled by the ultimate customer. The customer also would apply a chair base or legs, as desired. The legs or base form no part of the invention, can be conventional, and are therefore not shown.

Figure 2:
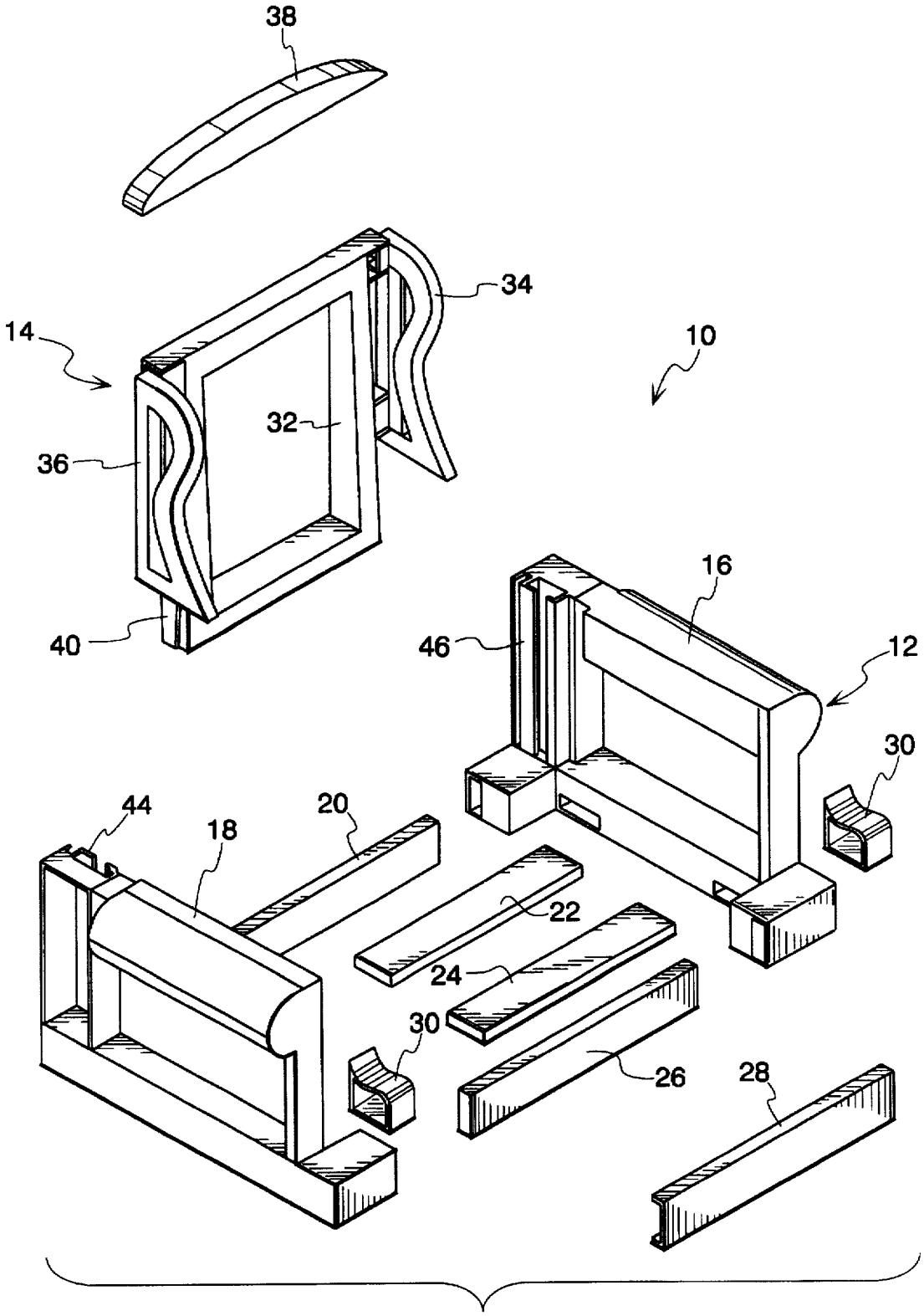
FIG. 2 is an exploded perspective view of the frame of FIG. 1.

For joining the back portion to the seat portion, a pair of double taper elements 40 and 42 are employed, each double taper element being located on one side of the back portion 14. A pair of corresponding channel elements 44 and 46 are located on the seat portion 12 for accommodating the taper elements 40 and 42. The taper elements 40 and 42 and the channel elements 44 and 46 are shown schematically in FIGS. 1 and 2, and are best shown in detail in FIGS. 3 and 4 for one side of the modular chair 10. It will be evident that the elements for the opposite side of the modular chair 10 would be formed in a mirror image to what is shown in FIGS. 3 and 4.

Figure 3A:
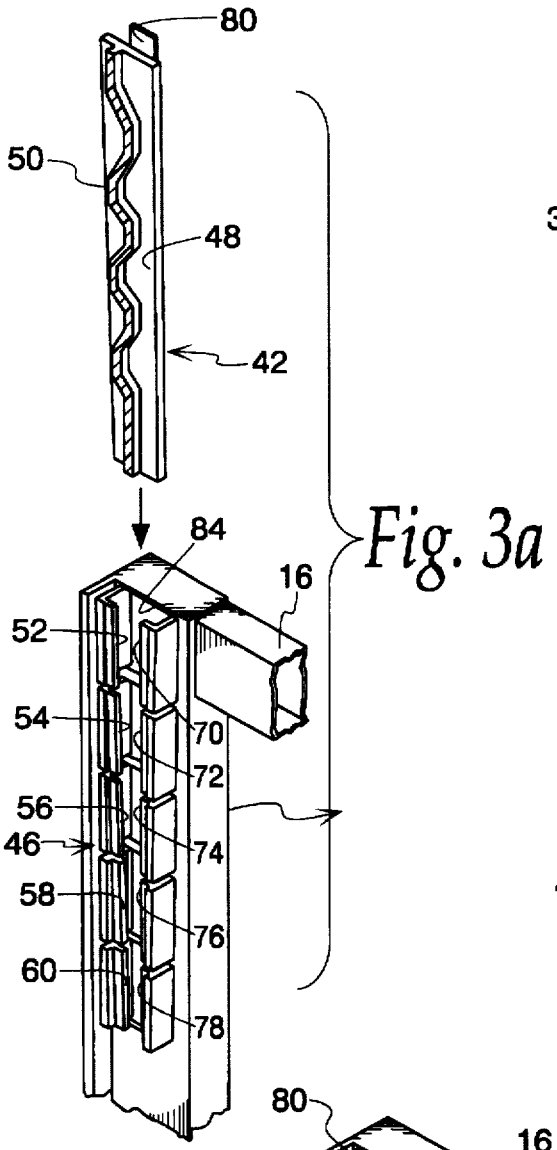
FIG. 3*a* is an enlarged perspective assembly view of portions of one side of the modular chair, showing how the wedges insert in the corresponding channel sections.
Figure 4A:
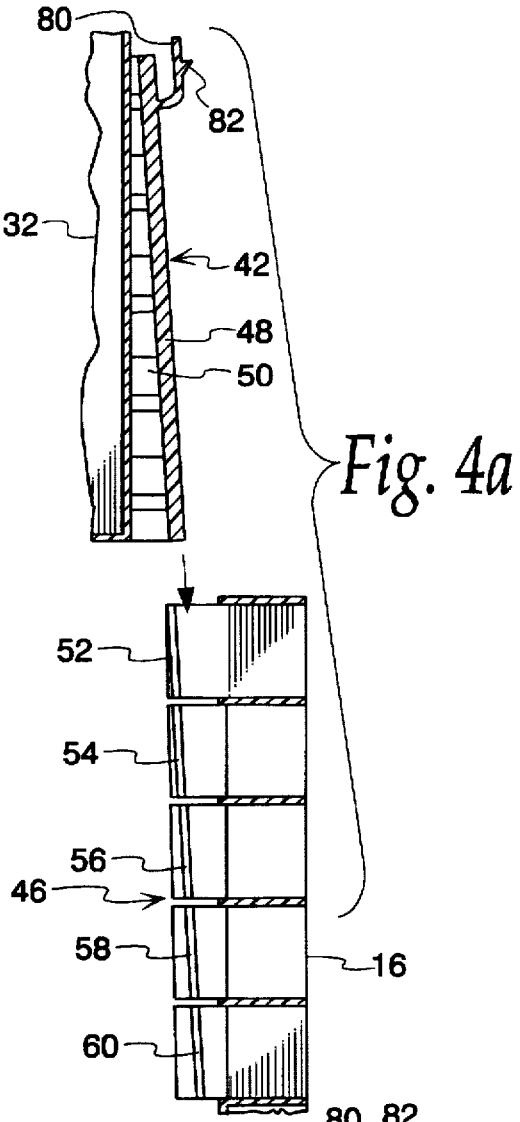
FIG. 4*a* is an enlarged elevational view similar to FIG. 3*a*, showing the assembly of the wedge and channel element.
Figure 3B:
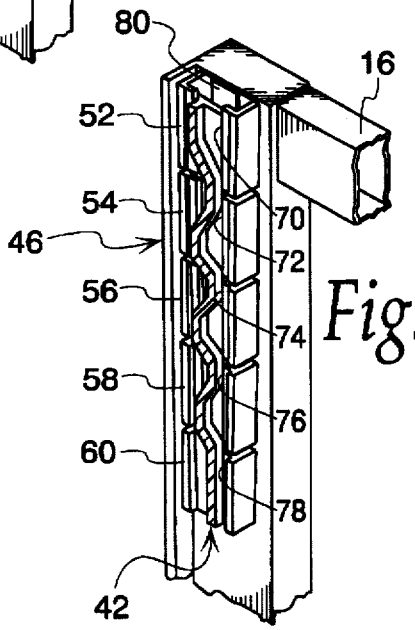
FIG. 3*b* is a view similar to FIG. 3*a*, with the two elements being joined together.
Figure 4B:
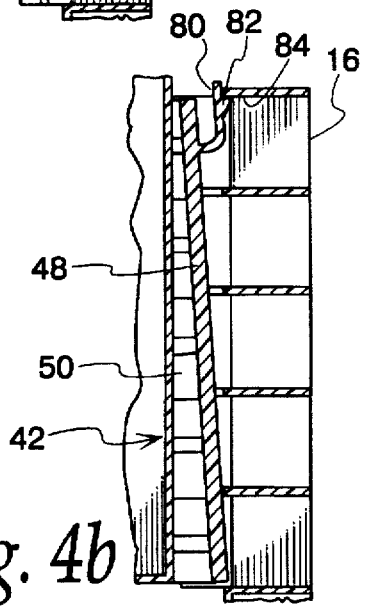
FIG. 4*b* is a view similar to FIG. 3*b*, with the two elements being joined and secured to one another.

Turning to FIGS. 3 and 4, the taper element 42 comprises an elongated wedge 48 and an undulating, tapered web 50 which secures the taper element 42 to the rear frame 32. As best shown in FIG. 3*a*, the wedge 48 is tapered from top to bottom to fit within a corresponding taper of the channel element 46. As best shown in FIGS. 4*a* and 4*b*, the web 50 is formed such that the top of the wedge 48 is closer to the rear frame 32 than the bottom of the wedge 48. The taper element 42 is therefore double tapered, in that it is formed in the form of the wedge 48, and is also tapered in relation to the rear frame 32 by the connecting web 50.

Each channel element 46 is comprised of a series of vertical channel sections 52 through 60 located one above the other. Each of the channel sections 52 through 60 includes a respective tapered opening 70 through 78 which is shaped to accommodate a corresponding taper of the undulating web 50 when the taper element 42 is installed in the channel element 46.

The taper element 42 also includes a flexible arm 80 extending therefrom and having a barb 82. The channel element 46 is formed with a recess 84, and is located so that when the taper element 42 is installed in the channel element 46, the barb 82 engages in the recess 84.

When the taper element 42 is installed in the channel element 46, the tapering of the element 42 and the corresponding tapering of the channel element 46 results in a jam fit between the taper element 42 and the channel element 46. Also, the tapered web 50 engages the tapered openings 70 through 78, resulting in a tight fit. Similarly, installation of the taper element 40 in the channel element 44 also results in a jam fit. When the taper element 42 is fully installed in the channel element 46, the barb 82 engages in the recess 84, permanently locking the back portion 14 to the seat portion 12. Therefore, not only is the back portion 14 firmly joined to the seat portion 12 by the jam fit, but also the portions 14 and 12 are secured to one another when the modular chair 10 is assembled.

Various changes can be made to the invention without departing from the spirit thereof or scope of the following claims.

What is claimed is:

1. A modular chair, comprising a. a seat portion and a back portion, the seat portion including opposite upstanding components, b. means for joining the back portion to the seat portion, comprising i. a pair of double taper elements, each double taper element being located on an opposite side of said back portion and spaced laterally therefrom, and ii. a pair of corresponding channel elements, each channel element being located in one of said upstanding components and being shaped to receive and engage tapered parts of a said double taper element, said tapered parts being oriented generally at right angles to one another, and c. means for securing the back portion to the seat portion.

2. A modular chair according to claim 1 in which said means for securing comprises at least one barb on one of said elements engaging a recess in another of said elements.

3. A modular chair according to claim 2 in which said barb is located on a flexible arm extending from a said taper element and said recess is located in a said channel element.

4. A modular chair according to claim 1 in which each double taper element comprises an elongated wedge and a web securing said wedge to and spacing said wedge from said back portion.

5. A modular chair according claim 4, in which said wedge is tapered from top of said wedge to bottom of said wedge.

6. A modular chair according to claim 5 in which said web is formed such that said top of said wedge is closer to said back than said bottom of said wedge.

7. A modular chair according to claim 1 in which each channel element comprises a plurality of vertical channel sections located one above another.

8. A modular chair according to claim 7 in which each channel section includes a tapered opening shaped to accommodate a said double taper element.

9. A modular chair, comprising a. a seat portion and a back portion, the seat portion including opposite upstanding components, b. means for joining the back portion to the seat portion, comprising i. a pair of double taper elements, each double taper element being located on an opposite side of said back portion, and each double taper element comprising an elongated wedge and a web securing said wedge to and laterally spacing said wedge from said back, and ii. a pair of corresponding channel elements, each channel element being located in one of said upstanding components and being shaped to receive and engage tapered parts of a said double taper element, said tapered parts being oriented generally at right angles to one another, and each channel element further comprising a plurality of vertical channel sections located one above another, and c. means for securing the back portion to the seat portion.

10. A modular chair according to claim 9 in which said means for securing comprises at least one barb on one of said elements engaging a recess in another of said elements.

11. A modular chair according to claim 10 in which said barb is located on a flexible arm extending from a said taper element and said recess is located in a said channel element.

12. A modular chair according claim 9, in which said wedge is tapered from top of said wedge to bottom of said wedge.

13. A modular chair according to claim 12 in which said web is formed such that said top of said wedge is closer to said back than said bottom of said wedge.

* * * * *